US010172487B2

(12) United States Patent
Toca

(10) Patent No.: US 10,172,487 B2
(45) Date of Patent: Jan. 8, 2019

(54) STEMMED GLASS AND STEMMED GLASS SET

(71) Applicant: Gustavo A. Toca, Santo Domingo (DO)

(72) Inventor: Gustavo A. Toca, Santo Domingo (DO)

(73) Assignee: Gustavo A. Toca, Santo Domingo (DO)

( * ) Notice: Subject to any disclaimer, the term of this patent is extended or adjusted under 35 U.S.C. 154(b) by 101 days.

(21) Appl. No.: 15/283,378

(22) Filed: Oct. 1, 2016

(65) Prior Publication Data

US 2017/0135508 A1 May 18, 2017

Related U.S. Application Data

(60) Provisional application No. 62/235,916, filed on Oct. 1, 2015.

(51) Int. Cl.
*A47G 19/22* (2006.01)
*A47G 19/23* (2006.01)

(52) U.S. Cl.
CPC ..... *A47G 19/2255* (2013.01); *A47G 19/2205* (2013.01); *A47G 19/23* (2013.01)

(58) Field of Classification Search
CPC ..... A47G 19/2255; A47G 19/2205; B65D 21/0201; B65D 21/0202; B65D 21/0204
USPC ..... 220/23.86, 23.83, 23.4, 23.6; 206/504
See application file for complete search history.

(56) References Cited

U.S. PATENT DOCUMENTS

2007/0157570 A1* 7/2007 Reeves ..... B65D 1/40 53/446

* cited by examiner

*Primary Examiner* — Stephen Castellano

(57) ABSTRACT

One embodiment of an stemmed glass including a bowl having a rim, a bowl base, and a continuous bowl surface extending between the rim and the bowl base; and a stem having an upper stem end attached to the bowl and a lower stem end attached proximate a periphery of a planar foot, such that the stem, the bowl base, and the planar foot define a space to accommodate a second stemmed glass bowl.

5 Claims, 6 Drawing Sheets

STEMMED GLASS AND STEMMED GLASS SET

CROSS REFERENCE TO RELATED APPLICATIONS

The present Application claims priority to U.S. Provisional Patent Application entitled "Interlocking beverage container," filed 1 Oct. 2015 and assigned filing No. 62/235,916; incorporated herein by reference in its entirety.

BACKGROUND

The present disclosure relates to stemmed glasses that can be compactly joined into sets, and the sets efficiently stacked.

The stemmed glass or stemware is a popular and necessary type of drinkware that has, in its basic form of a bowl and a foot connected by a centered stem, remained practically unchanged for centuries. The problem is that due to its characteristic shape stemware is difficult to store as it takes more space than conventional stemless drinkware and is usually not stackable. This creates a storage problem for houseware and barware applications. The problem also extends to the single serve market and more particularly to the single serve wine and spirits market where there's the particular need for sealed filled containers that can be compactly packed for efficient shipping and shelving, with good portability and functional characteristics, and have physical characteristics as close as possible to a full stemmed glass.

BRIEF DESCRIPTION

The features and advantages of the present disclosure is set forth in the detailed description which follows, and will be apparent to those skilled in the art from the description or recognized by practicing the disclosed embodiments as described, together with the claims and appended drawings.

DETAILED DESCRIPTION

Figure 2:
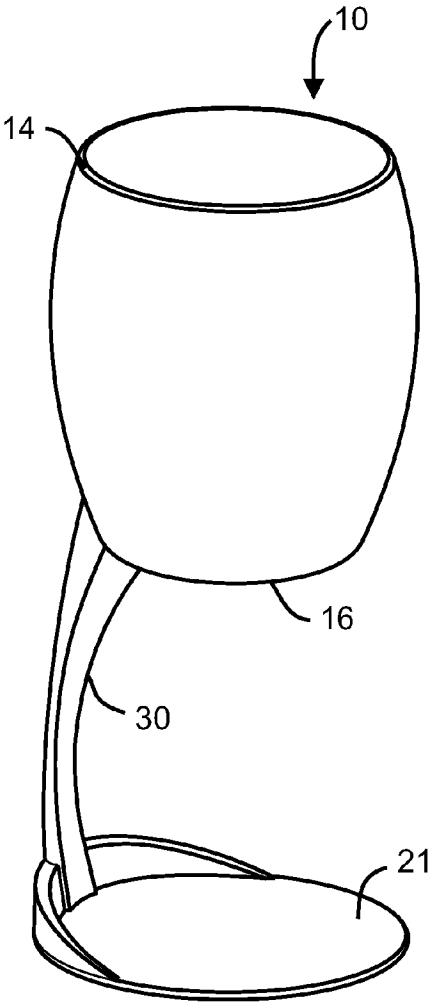
FIG. 2 depicts a perspective view of the stemmed glass of FIG. 1.
Figure 1:
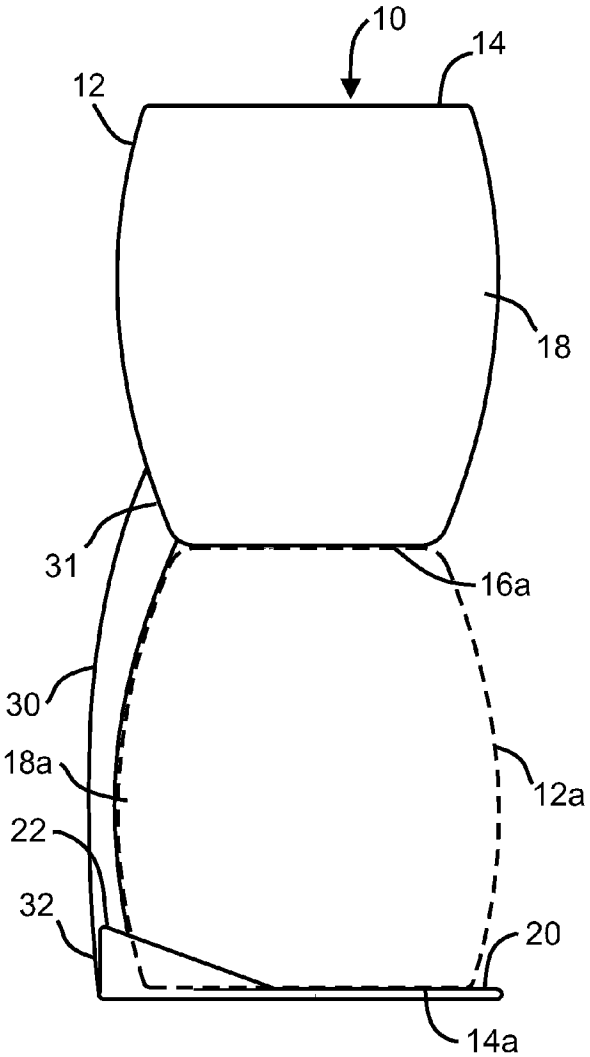
FIG. 1 depicts a side view of an embodiment of a stemmed glass as disclosed herein.

FIGS. 1 and 2 depict a stemmed glass 10, here configured to be an article of stemware similar to a wine glass, in accordance with one embodiment. Stemmed glass 10 includes a bowl 12 with a bowl rim 14, a planar bowl base 16 and a bowl surface 18 laterally extending between the bowl rim 14 and the planar bowl base 16. The bowl surface 18 is contiguous with, and merges into, the planar bowl base 16 to form the bowl 12. In the particular embodiment, the bowl 12 is depicted to have a bi-convex configuration with a planar bowl base 16, but it should be understood that the shape can be varied as desired by a designer to have, for example, an oval cross section, a fluted, conical or tulip shape with a narrow pointed bowl base, or an angular shape with one or more planar surfaces, such as pyramidal or rectangular, for example.

A foot 20 is depicted with a substantially planar foot surface 21. A stem 30 is depicted with an upper stem end 31 attached to the bowl surface 16 and a lower stem end 32 attached proximate a periphery of planar foot surface 21.

A bowl 12*a*, with the same shape and dimensions as bowl 12, depicted in broken lines is disposed in a volume of space defined by the planar bowl base 16, the stem 30, and the planar foot surface 21, with a bowl base 16*a* disposed adjacent the planar bowl base 16 and substantially aligned with it, a bowl rim 14*a* disposed adjacent the planar foot surface 21, and a bowl surface 18*a* is disposed against the stem 30.

The stem 30 is depicted in this embodiment to substantially conform to the shape of a bowl surface 18*a*, however it should be understood that, in other embodiments, the stem 30 can be configured to have a shape that does not conform to the shape of the bowl surface 18*a* having, for example, only a portion of its length in contact with bowl surface 18*a*, or alternatively have no contact at all with bowl surface 18*a*.

In this embodiment, a raised lip 22 on the foot 20 that merges into the lower stem end 32 to provide additional mechanical stability to the stem 30 and the foot 20. In the embodiment depicted, the raised lip 22 is substantially an arc-shaped, rim-like feature generally conforming to the circumference or periphery of the foot 20. Alternatively, the raised lip 22 can optionally be configured as an oval, or another polygonal shape, for example. The raised lip 22 can also be configured to give a better aesthetic appearance to the stemmed glass 10. The foot 20 can optionally be configured as an oval, an elliptical, a square, or another polygonal shape, for example.

The stemmed glass 10 can be manufactured as a single, one-piece unitary component. Alternatively, the stemmed glass 10 can be manufactured as a multipart article of two or more parts assembled together to conform a single product, where in the stem 30 can be physically secured to the bowl 12 or to the foot 20, or to both, by a suitable adhesive, or by thermal or mechanical attachment. In an exemplary embodiment, the stemmed glass 10 can be fabricated from a transparent polymeric material such as, for example, food grade polyethylene terephthalate (PET). Other suitable materials can be used such as, for example, glass, non-transparent polymers, or combinations of materials such as a glass bowl with a stem and foot made of polymeric materials.

Figure 3:
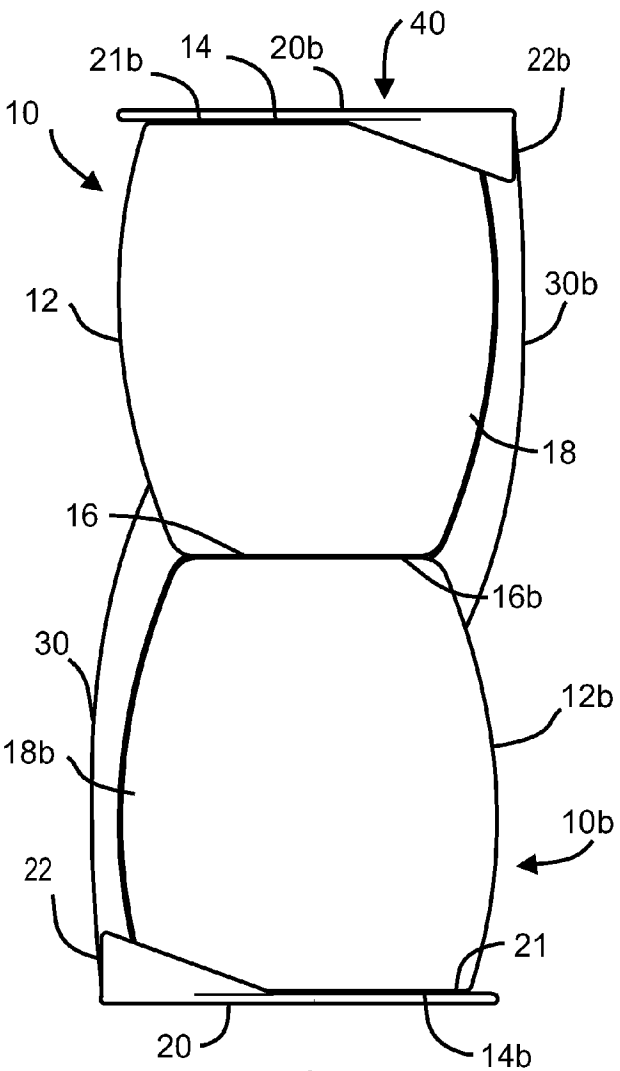
FIG. 3 depicts a side view of the stemmed glass of FIG. 1 joined with a second stemmed glass to form a stemmed glass set.

The joining feature of the disclosed stemmed glass 10 can be best explained with reference to FIG. 3 in which the stemmed glass 10 is placed adjacent to a second stemmed glass 10*b* and joined to form a stemmed glass set 40. The second stemmed glass 10*b* is inverted with respect to the stemmed glass 10 so that a bowl 12*b* faces the foot 20 of stemmed glass 10, and can be placed with a bowl rim 14*b* disposed against the planar foot surface 21 of the stemmed glass 10. The bowl rim 14 is disposed against a planar foot surface 21*b*, the bowl surface 18 is disposed against a stem 30*b*, the planar bowl base 16 is disposed against a planar bowl base 16*b*, and a bowl surface 18*b* is disposed against the stem 30. The bowl 12 of the stemmed glass 10 is substantially aligned with a bowl 12*b* of the second stemmed glass 10*b*. Stemmed glass sets can be stacked.

The raised lip 22 of the first stemmed glass 10 can be configured to conform to the shape of the bowl 12*b* and be disposed adjacent to it to aid in retaining it in place for easier handling.

Figure 4B:
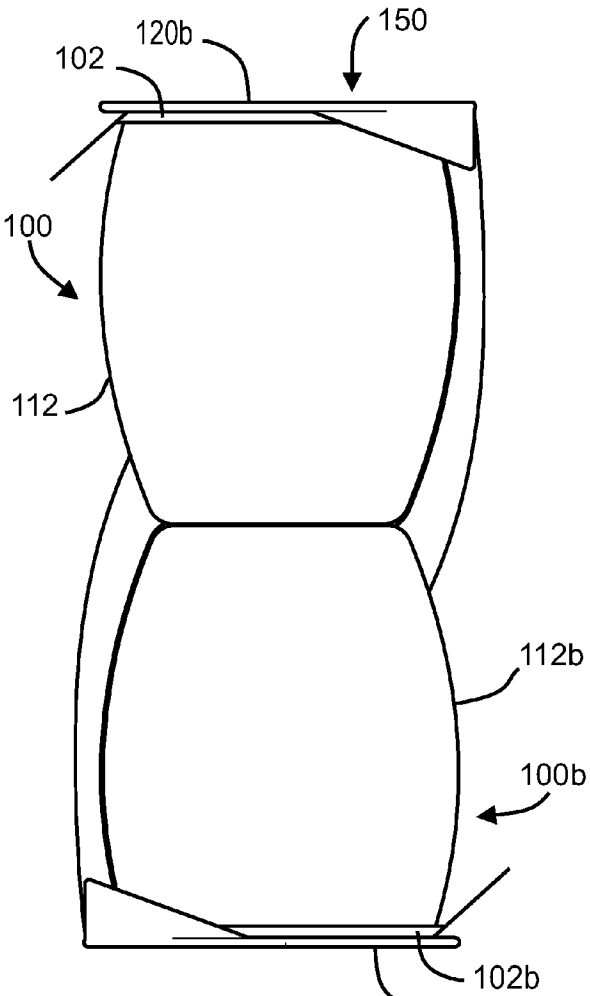
FIG. 4B of the stemmed glass of FIG. 4 joined with a second stemmed glass to form a stemmed glass set.
Figure 4:
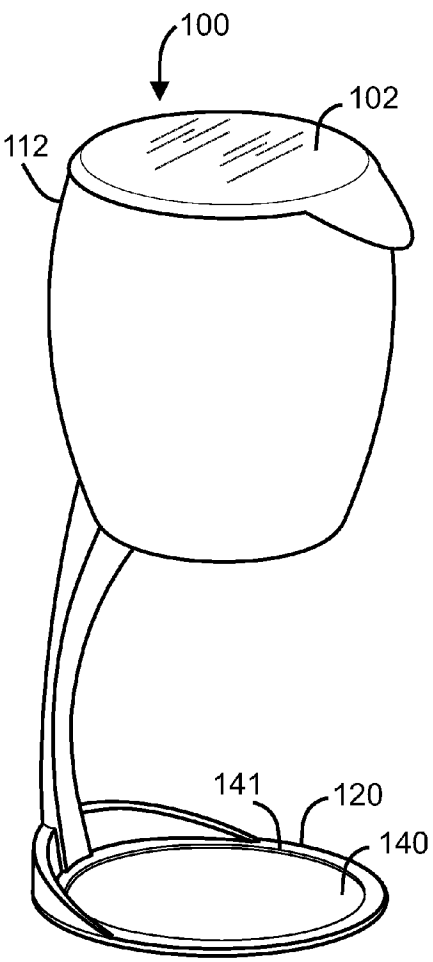
FIG. 4 depicts a perspective view of an embodiment of a stemmed glass as disclosed herein.

In one embodiment, FIG. 4 depicts a stemmed glass 100, here configured as a single serve beverage container including a seal 102 removably attached to a bowl rim (not shown) of the stemmed glass 100 and covering a bowl opening (not shown) of a bowl 112. The seal 102 is a foil seal, but other sealing methods can be used such as lift-and-peel or induction, for example. The stemmed glass 100 is depicted having a circular shallow recess 140 and a recess wall 141 in a foot 120.

FIG. 4B depicts the stemmed glass 100 joined with a second stemmed glass 100*b*, having a removable seal 102*b*. When a bowl rim (not shown) with the seal 102*b* of the second stemmed glass is placed into the circular shallow recess 140 of the stemmed glass 100, the recess wall 141 can serve to retain a bowl 112*b* of the second stemmed glass 100*b* inhibiting lateral movements of the second stemmed glass 100*b*. The diameter of the circular shallow recess 140 is sized to be slightly larger than the diameter of the bowl rim of the second stemmed glass 100*b* to ensure a tight grip, but a larger diameter sizes can be used. The foot 120 can serve as a puncture protector for the seal 102*b* of the second stemmed glass 100*b* when joined with the stemmed glass 100 as set. The same applies to the stemmed glass 100 when joined with the stemmed glass 100*b* as a set.

The stemmed glass set 150 can be covered with a removable plastic film wrapper (not shown) to aid in keeping the two stemmed glasses tightly joined for handling and shipping. Additionally, the removable plastic wrapper aids in keeping the stemmed glasses sanitary by preventing contaminants from reaching their surfaces. Moreover, the removable plastic wrapper can be made of UV or light resistant material to protect the liquid content of the glasses from their effects.

Figure 5:
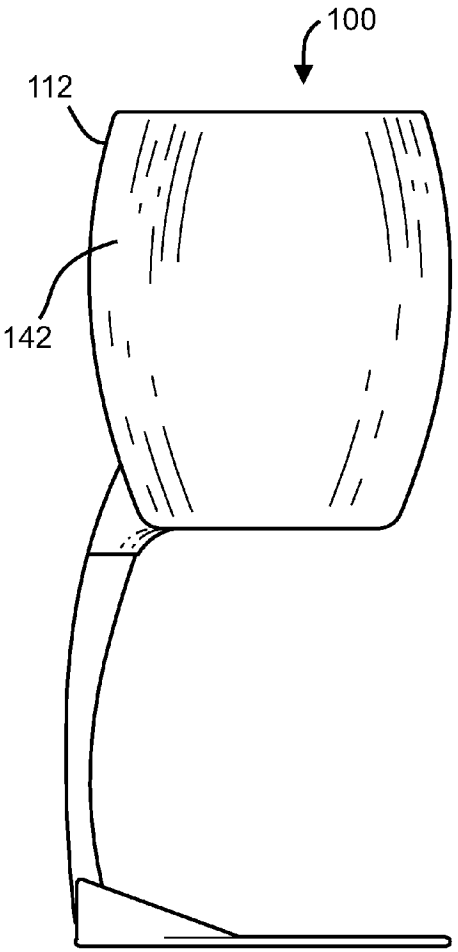
FIG. 5 depicts a side view of the stemmed glass of FIG. 4 with plastic wrapping.

For single unit handling, stacking and shelving of the stemmed glass 100, alternative protection of the seal 102 can be achieved by covering the bowl 112 and the seal 102 fully or partially with a removable plastic film wrapper 142, as depicted in FIG. 5.

Alternatively, the bowl 112 of the stemmed glass 100 can be protected with a plastic cap (not shown). The cap is frictionally held over the top of the bowl 112. Alternatively, the cap can be held by the removable plastic film wrapper depicted in FIG. 5 or by screwing or by clipping on, for example. The cap can alternatively be fabricated of metal, or plastic with coated metal, a rubberized metal, wood, or a combination of conventional materials as well known in the relevant art.

Figure 6:
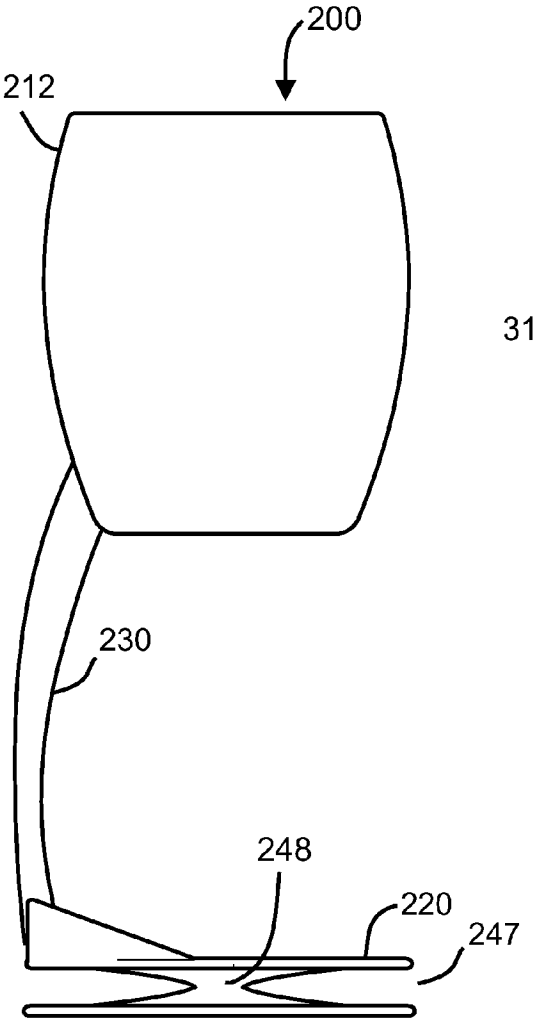
FIG. 6 depicts a side view of an embodiment of a stemmed glass as disclosed herein.

FIG. 6 depicts one embodiment of a stemmed glass 200 including a bowl 212, a stem 230, a foot 220 and a rack adapter 246. The rack adapter 246 provides a channel-like opening 247 sized and shaped to allow the stemmed glass 200 to be placed into a standard wine glass rack (not shown). In the example shown, the rack adapter 246 features a double opposing cone shape 248. However, it should be understood that other shapes can be used such as a single cone shape or a cylindrical shape, for example.

Figure 7:
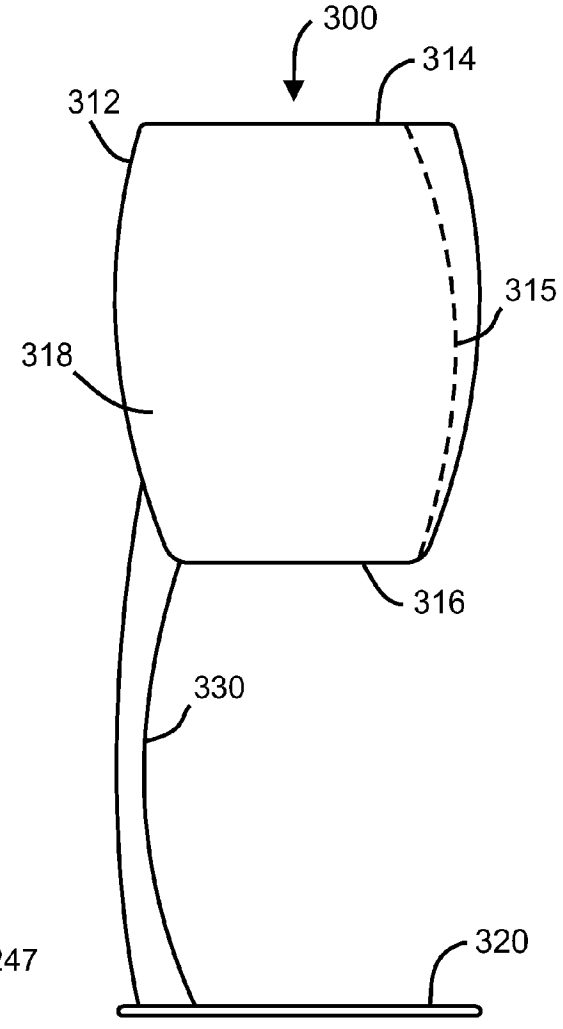
FIG. 7 depicts a side view of an embodiment of a stemmed glass as disclosed herein.

For applications in which a more compact configuration is desired, one embodiment of a stemmed glass 300 is depicted in FIG. 7. The stemmed glass 300 includes a bowl 312, a bowl rim 314, a bowl groove 315, a bowl base 316, a foot 320, and a stem 330 disposed in the bowl groove 315. The bowl groove 315 is depicted here to extend from the bowl base 316 to the bowl rim 314 all along the bowl surface 318, but it should be noted that the bowl groove 315 can have a shorter length, for example extending from the bowl base 316 to the middle of the bowl 312 such that only a portion of the stem 330 is disposed in it.

Figure 8:
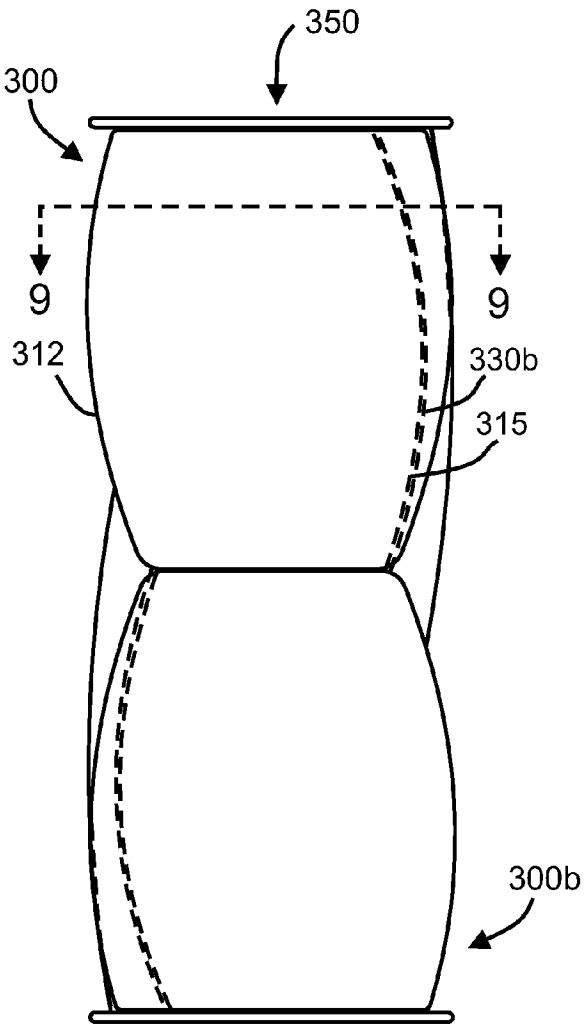
FIG. 8 depicts a side view of the stemmed glass of FIG. 7 joined with a second stemmed glass to form a stemmed glass set.

FIG. 8 depicts the stemmed glass 300 joined with a second stemmed glass 300*b* to form a stemmed glass set 350.

Figure 9:
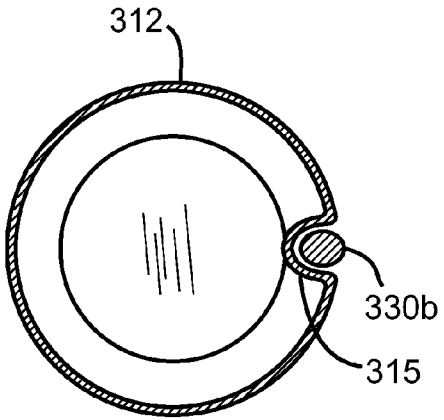
FIG. 9 depicts a top sectional view of FIG. 8.

FIG. 9 depicts a top sectional view depicting a stem 330*b* of the second stemmed glass 300*b* disposed within the bowl groove 315 of the bowl 312 of the stemmed glass 300. The interior surface of the bowl groove 315 substantially conforms to the exterior surface of the stem 330.

Figure 10:
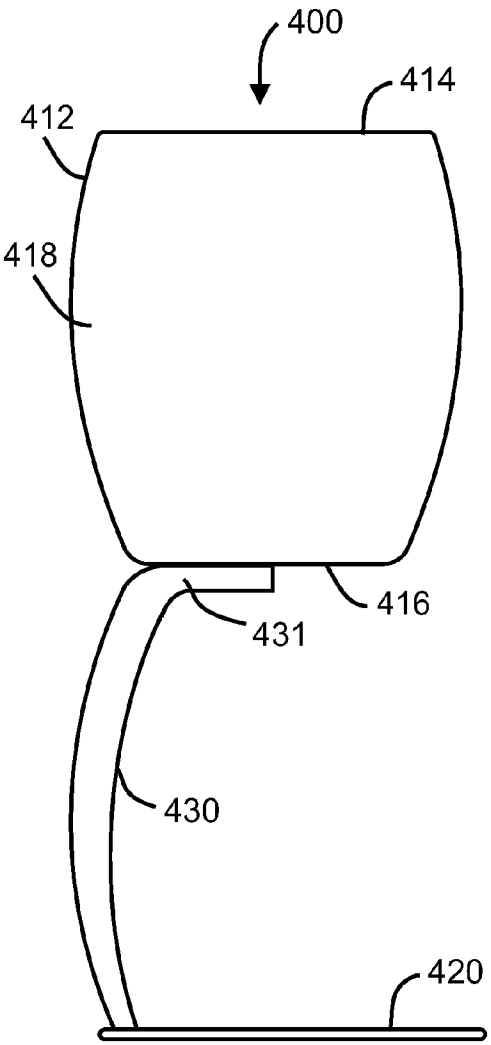
FIG. 10 depicts a side view of an embodiment of a stemmed glass as disclosed herein.

FIG. 10 depicts one embodiment of a stemmed glass 400 including a bowl 412, a rim 414, a planar bowl base 416, a bowl surface 418, a foot 420, and a stem 430 with an upper stem end 431 attached to the bowl base 416.

Figure 11:
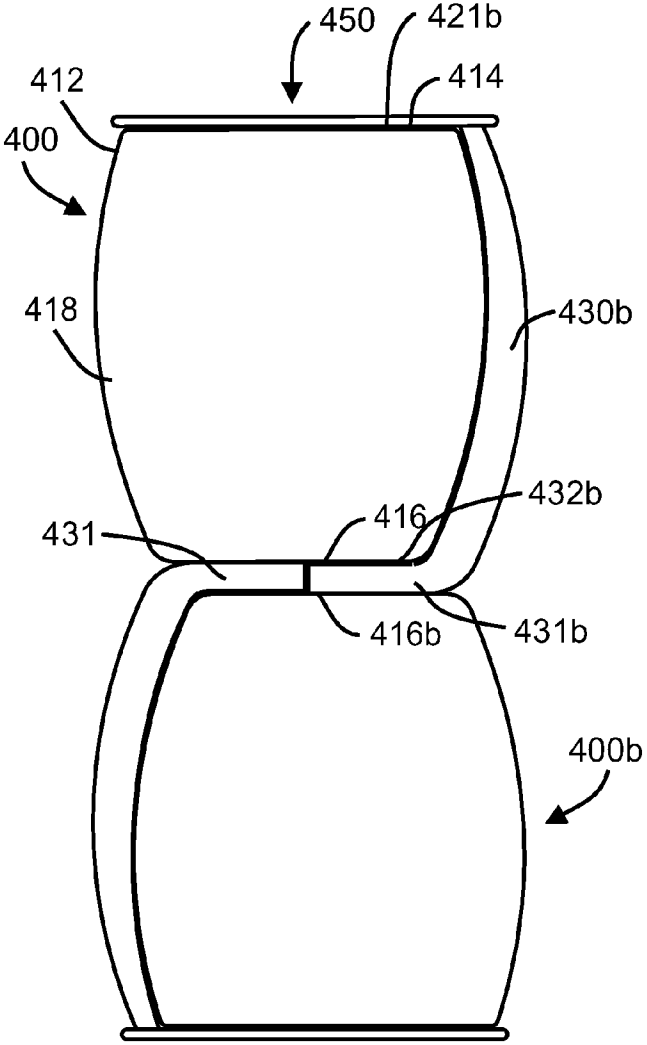
FIG. 11 depicts a side view of the stemmed glass of FIG. 10 joined with a second stemmed glass to form a stemmed glass set.

FIG. 11 depicts the stemmed glass 400 joined with a second stemmed glass 400*b* to form a stemmed glass set 450. The bowl rim 414 disposed against a planar foot surface 421*b*, and the bowl surface 418 is disposed against a stem 430*b*. The upper stem end 431 extends from an edge of the periphery of the bowl base 416 to proximate the center of the bowl base 416 allowing an opposing upper stem end 431*b*, extending from an edge of the periphery of a bowl base 416*b* to proximate the center of the bowl base 416*b*, to be disposed proximate the bowl base 416 from the opposing edge of the periphery of the bowl base 416 to proximate the center of the bowl base 416. In this embodiment, the bowl 412 of the stemmed glass 400 and a bowl 421*b* of the second stemmed glass 400*b* are configured to be substantially misaligned from one another when joined as stemmed glass set 450, but it should be understood that in other embodiments they can be configured to align.

Figure 12:
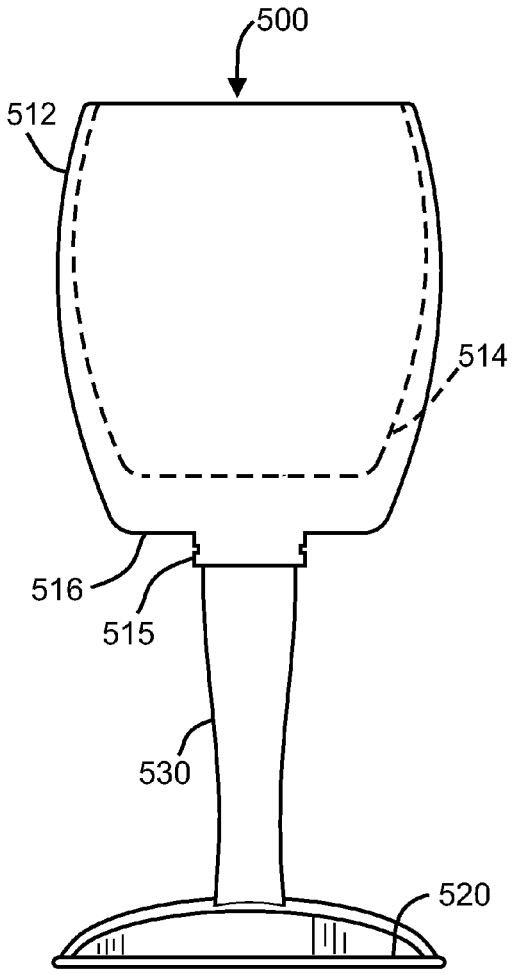
FIG. 12 depicts a frontal view of an embodiment of a stemmed glass as disclosed herein.

FIG. 12 depicts a frontal view of one embodiment of a stemmed glass 500 including a bowl 512 with an internal bowl cavity 514, a male connector 515 attached to a bowl base 516; a foot 520, and a stem 530. In this embodiment, the male connector 515 is a slide-in type, but other types of connectors or fasteners can be used such as, for example, snap-in or slide-and-twist in other alternative embodiments.

Also, in this embodiment, the male connector 515 is attached to the bowl base, but it can alternatively be attached to the stem 530.

Figure 13:
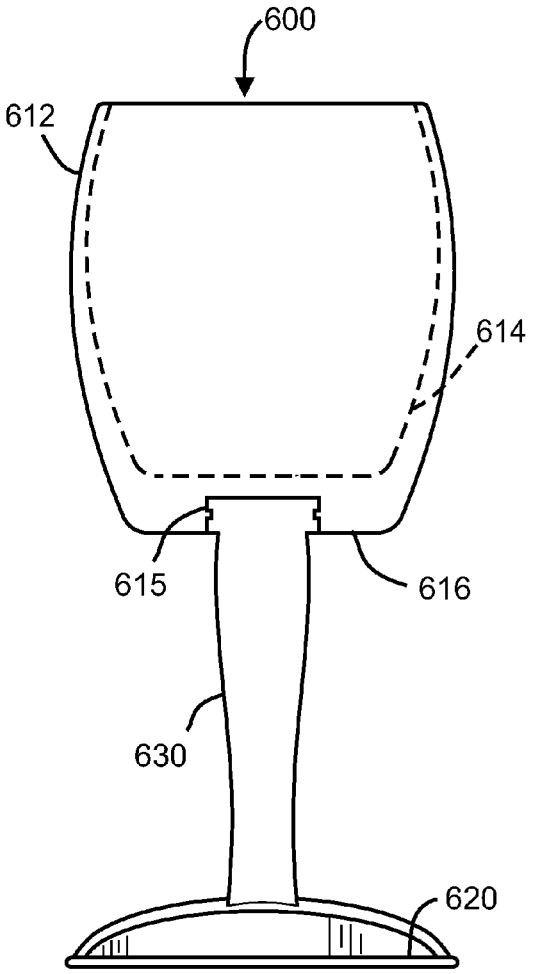
FIG. 13 depicts a frontal view of an embodiment of a stemmed glass as disclosed herein.

FIG. 13 depicts a frontal view of one embodiment of a stemmed glass 600 including a bowl 612 with an internal bowl cavity 614, a bowl base 616, a foot 620, a stem 630, and a female connector 615 disposed inside bowl 612 between bowl base 616 and the bottom of the internal bowl cavity 614. Female connector 615 has an opening which extends through bowl base 616 and permits coupling with the male connector 515 of the stemmed glass 500.

Figures 14, 15, 16:
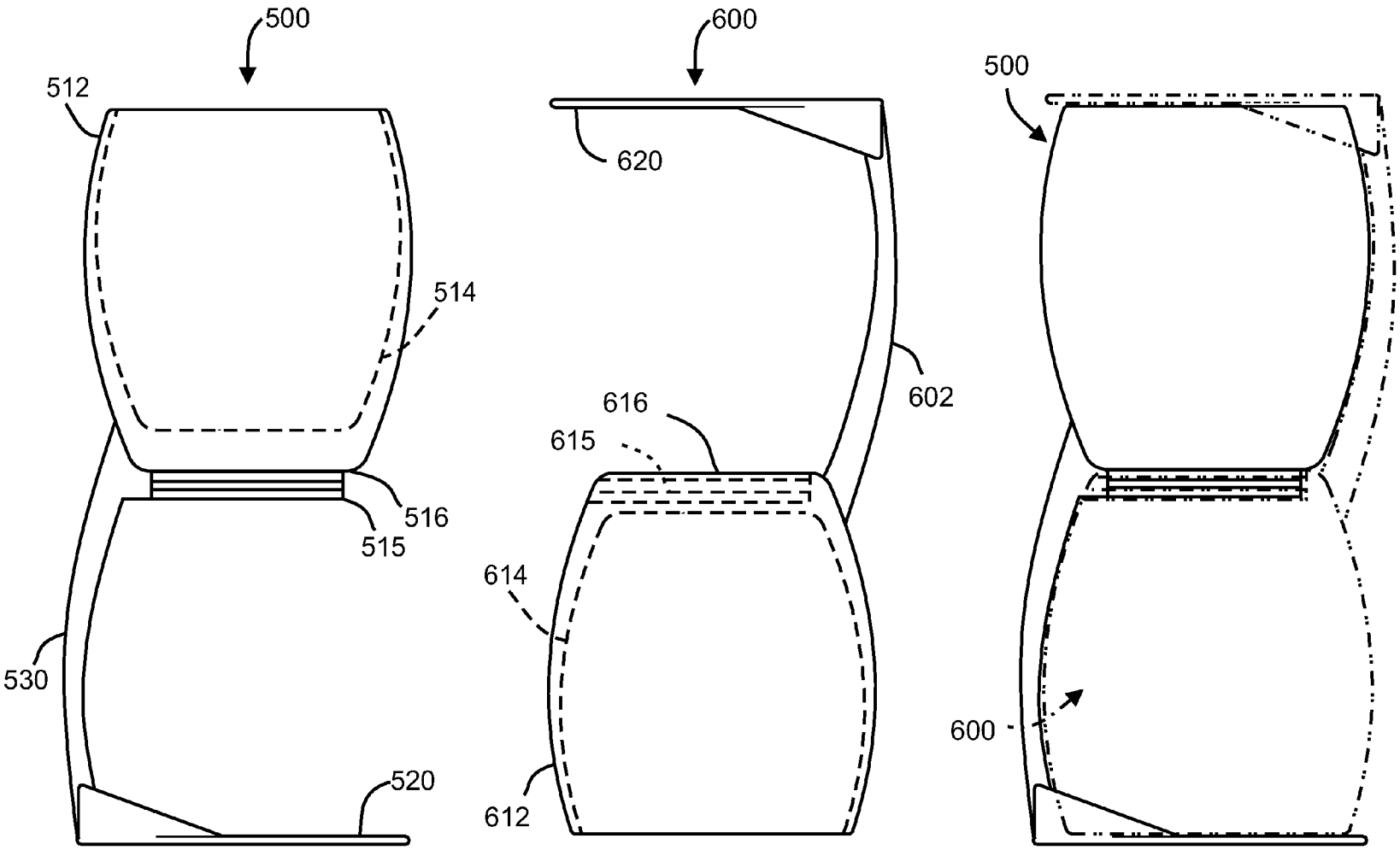
FIG. 14 depicts a side view of the stemmed glass of FIG. 12.
FIG. 15 depicts a side view of the stemmed glass of FIG. 13 inverted.
FIG. 16 depicts a side view of the stemmed glass of FIG. 14 joined with the stemmed glass of FIG. 13 to form a stemmed glass set.

FIG. 14 depicts a side view of stemmed glass 500. FIG. 15 depicts a side view of stemmed glass 600 inverted with respect to stemmed glass 500.

FIG. 16 depicts the stemmed glass 500 joined with a second stemmed glass 600 to form a stemmed glass set.

What is claimed is:

1. A stemmed glass set comprising:

a first stemmed glass comprising a first bowl, a first stem, and a first foot, said first bowl having a first rim, said first bowl having a first surface contiguous with a first bowl base, said first bowl configured to hold a liquid therein; and a second stemmed glass comprising a second bowl, a second stem, and a second foot, said second bowl having a second rim, said second bowl having a second surface contiguous with a second bowl base, said second bowl configured to hold a liquid therein; and said first stemmed glass joined with said second stemmed glass such that said first rim is disposed proximate said second foot and said first bowl is disposed in a volume defined by said second foot, said second stem, and said second bowl base.

2. A method of assembling a stemmed glass set, said method comprising the steps of:

obtaining a first stemmed glass comprising a first bowl, a first stem, and a first foot, said first bowl having a first bowl base and a first rim, said first bowl configured to hold a liquid therein;

obtaining a second stemmed glass comprising a second bowl, a second stem, and a second foot, said second bowl having a second bowl base and a second rim, said second bowl configured to hold a liquid therein; and placing said first stemmed glass adjacent to said second stemmed glass such that said first rim is disposed proximate said second foot and said first bowl is disposed in a volume defined by said second foot, said second stem, and said second bowl base.

3. The method of claim 2 wherein said step of placing comprises a step of positioning said first bowl base proximate said second bowl base.

4. The method of claim 2 wherein said step of placing comprises a step of positioning at least a portion of said first stem proximate said second bowl.

5. The method of claim 2 wherein said step of placing comprises a step of positioning at least a portion of said second stem into a groove in said first bowl.

* * * * *